US006044894A

United States Patent [19]

Fujita et al.

[11] Patent Number: 6,044,894

[45] **Date of Patent: *Apr. 4, 2000**

[54] METHOD FOR PREPARING A LIGHT METAL OR LIGHT METAL ALLOY BASED COMPOSITE PRODUCT

[75] Inventors: Makoto Fujita, Higashihiroshima; Kazuo Sakamoto, Hiroshima; Yukihiro Sugimoto, Higashihiroshima; Yukio Yamamoto, Hiroshima, all of Japan

[73] Assignee: Mazda Motor Corporation, Hiroshima-ken, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/603,865

[22] Filed: Feb. 22, 1996

[30] Foreign Application Priority Data

| | | | |
|---|---|---|---|
| Feb. 22, 1995 | [JP] | Japan | 7-059833 |
| Aug. 3, 1995 | [JP] | Japan | 7-197842 |
| Sep. 26, 1995 | [JP] | Japan | 7-.0247417 |

[51] Int. Cl.[7] ..... B22D 19/14

[52] U.S. Cl. ..... 164/97; 164/98; 264/44; 264/621; 264/628

[58] Field of Search ..... 164/97, 98; 264/621, 264/628, 44

[56] References Cited

U.S. PATENT DOCUMENTS

| | | | |
|---|---|---|---|
| 4,548,253 | 10/1985 | Funatani et al. | 164/97 X |
| 4,852,630 | 8/1989 | Hamajima et al. | 164/97 X |
| 4,883,779 | 11/1989 | McAllister et al. | 264/621 X |
| 4,995,444 | 2/1991 | Jolly et al. | 164/97 |
| 5,236,032 | 8/1993 | Nukami et al. | 164/98 |
| 5,354,528 | 10/1994 | Akiyama et al. | 164/97 X |
| 5,511,603 | 4/1996 | Brown et al. | 164/97 |

FOREIGN PATENT DOCUMENTS

| | | | |
|---|---|---|---|
| 2675063 | 10/1992 | France | 164/97 |
| 3828884 | 3/1989 | Germany | 164/97 |
| 4112693 | 11/1991 | Germany | 164/97 |
| 3-151158 | 6/1991 | Japan . | |

*Primary Examiner*—J. Reed Batten, Jr.
*Attorney, Agent, or Firm*—Morrison & Foerster LLP

[57] ABSTRACT

A method for preparing a light metal or light metal alloy composite product, wherein (a) an aqueous slurry containing water, a reinforcement powder, a metal powder and an alumina sol binder is prepared; (b) a preform is prepared from the slurry; (c) the preform is sintered; and (d) the sintered preform is impregnated with a melt of a light metal or a light metal alloy to produce a light metal or a light metal alloy based composite product.

27 Claims, 12 Drawing Sheets

METHOD FOR PREPARING A LIGHT METAL OR LIGHT METAL ALLOY BASED COMPOSITE PRODUCT

FIELD OF THE INVENTION

The present invention relates to a method for preparing a light metal or light metal alloy based composite material or product, especially to aluminum or magnesium matrix based complex product which is partially reinforced at necessary portions by means of reinforcement preform.

BACKGROUND OF THE INVENTION

Many parts for automobile such as edge of a piston top ring part, a brake disk rotor part and a bulb lifter part require resistance to abrasion at a sliding zone and thus have been made of an aluminum composite material in which matrix metal is combined with reinforcement material having resistance to abrasion.

As a method for preparing the aluminum composite material, there is well known a so called melt-stirring method, in which a melt of aluminum is mixed with 5 to 30 wt.% of the reinforcement powders such as SiC while being stirred and then is cast into a product or element. Therefore, throughout the parts of the resulting product, besides the sliding zone necessary to be reinforced, the reinforcement material is distributed. Additionally a pouring gate and a feeder head used for casting also have the reinforcement material. The thus total amount of the reinforcement material to be used becomes larger and costly.

There has been requested to provide a method for making a partially reinforced composite product in order to decrease the production cost and there was proposed a so-called high pressure casting method, as shown in Japanese Patent Kokai Hei No. 3-151158, in which a mixture of SiC whiskers (short fiber crystalline having a diameter of micron order) and aluminum based metal powders is sintered into a composite preform having a determined shape, which is further provided at the surface with a thin layer of noble metal based material. The composite preform is set at a determined position in a mold, into which a melt of aluminum based metal is poured under a high pressure (for example 1000 $kg/cm^2$). Thereby, the resulting product comes to be reinforced partially due to the composite matrix covered with the melt.

However, large amount of SiC whiskers must be still used as the reinforced material because SiC whiskers are fibers. Therefore, it results in high production cost and also results in high damage against the other partner parts. Further, SiC whiskers are difficult to be adjusted with respect to mixture ratio between the aluminum matrix and the reinforcement (SiC) and thus result in high volume ratio (Vf) of SiC whiskers in the composite matrix, even though a composite material having a low volume ratio is required in practical use.

Therefore, it is an object of the present invention to provide a method for preparing a light metal based composite material having a low volume ratio of the reinforcement material.

According to a first aspect of the present invention, there can be provided a method for preparing a light metal or a light metal alloy based composite product, which comprises steps:

(a) preparing an aqueous slurry comprising water, reinforcement powders and a binder;

(b) preparing a preform mainly composed of said reinforcement powders and binder from said slurry;

(c) sintering said preform;

(d) impregnating the sintered preform in a mold with a melt of aluminum or a light metal alloy to give aluminum or a light metal alloy based composite product.

The composite material products thus prepared result in a partially reinforced light metal based composite product with an optional volume ratio of the reinforcement material, especially a low volume ratio which is actually required.

The method according to the present invention can be applied to a matrix metal selected from the group consisting of aluminum, Al alloys and Mg alloys such as AZ91D.

The aqueous slurry can be prepared from water, the reinforcement powders and the binder. The reinforcement powder is used for reinforcing the matrix metal in terms of resistance to abrasion or corrosion and also improvement in mechanical strength, which is selected from 1) ceramic powders and 2) metal powders for making an intermetallic compound with said light metal or light metal alloy (matrix metal). The ceramic powder may be selected from the group consisting of SiC, SiN, $TiO_2$ and $Al_2O_3$. On the other hand, the metal powder may be selected from the group consisting of Ni, Cu, Fe and Ti. In case the ceramic powder is SiC, the average size of SiC powders is preferably within 10 to 20 $\mu$m, especially about 15 $\mu$m, because less than 10 $\mu$m lowers the resistance to abrasion of the resulting composite product while more than 20 $\mu$m deteriorates the processability. In case the metal powder is Ni, the average size of Ni powders is preferably within 20 to 40 $\mu$m, especially 30 $\mu$m, because less than 20 $\mu$m does not improve resistance to abrasion of the composite product while more than 40 $\mu$m deteriorates the processability.

The binder is used to bind the reinforcement powders in the preform and among many kinds of the binders, alumina sol is preferred considering bonding strength between the reinforcement powders. The alumina sol is an alumina hydrate boehmite which has colloids of about 5 to 200 m$\mu$ and contains a stabilizer such as Cl—, $CH^3COO$—, $NO_3$— and so on. Kinds of alumina sol-100, 200 and 520 are available. The mixture ratio between the reinforcement powders and the binder should be determined considering the form retention of the preform. In case no aluminum or aluminum alloy powders are added with slurry, there should be added 0.5 to 5 wt.% of alumina sol based on the weight of the reinforcement material. On the other hand, in case aluminum or aluminum alloy powders are added in the slurry, there should be added 0.5 to 3 wt.% of alumina sol based on the total weight of the reinforcement material and the aluminum or aluminum alloy powders.

The slurry may further comprise a volatile material for making spaces, to be filled with the matrix metal, in the preform due to volatilization during the sintering step. The volatile material may be selected from graphite or organic material such as phenol resins. The volatile material has average size of 35 to 55 $\mu$m and the content may be within a range from 0 to 35 volume %, based on the volume of the preform. The resulting volume ratio of the preform is preferably within a range from 5 to 30 %. In case of the preform should have 20 volume ratio, the slurry is preferably prepared by mixing 20 vol.% of the reinforcement material and 20 vol.% of the volatile material. Further, in case aluminum, Al alloy or Mg alloy is a matrix of said composite product, the slurry may further comprise aluminum powders, Al alloy powders and/or Mg alloy powders. In case of Mg alloy powders, Mg particles of more than 200 $\mu$m should be used. Therefore, the preferred slurry may comprise water, the reinforcement powders, the binder, aluminum powders and/or light metal alloy powders and the volatile material for making spaces, such as graphite.

In preparing the preform, since the slurry contains much water, it is preferred that, the preforming step (b) can be carried out by (1) dehydrating the slurry in a preform mold to prepare a preform mainly composed of said reinforcement powders and binder; and (2) compressing the dehydrated preform.

In the sintering step, while the preform nay be sintered at a temperature lower than the melting point of the matrix metal, a sintering temperature higher than the melting point may be selected depending on the desired strength of the preform. However, since alumina sol can be crystallized to $\gamma$-$Al_2O_3$ at a temperature higher than 485° C., preventing alumina sol from reacting with Mg in the matrix, it should be carried out at a temperature higher than 500° C. Otherwise, the alumina sol reacts with Mg in the matrix, resulting in insufficient extraction of $Mg_2Si$ during the heat treatment for improving the mechanical strength of the composite product. In case metal powders, such as Ni powders, are used in the slurry forming the intermetallic compound, the sintering temperature may be higher than 530° C. in order to be able to form the metal intermetallic compound with the matrix metal. In case the matrix metal is other than the reinforcement material to make the slurry composition, the sintering temperature may be preferably higher than its melting point (for example, aluminum based alloys: about 570° C.; their powder: 530–540° C.) because the sintering temperature causes melting of the matrix metal which makes the reinforcement powders to be combined together strongly in a network form with the aid of the alumina sol. Therefore, the preform, especially composed of the aluminum based alloy may be sintered at a temperature higher than 580° C., but should not be done above 900° C. because such a high temperature may fail to keep the form retention of the preform.

In the present invention, the resulting composite product is preferred to be subjected to T6 heat treatment since the product contains sufficient Mg due to sufficient transfer from the alumina sol to $\gamma$-alumina during the sintering step, so that the T6 heat treatment makes Mg component to combine Si component to form $Mg_2Si$ which improves the mechanical strength of the resulting composite product.

BRIEF DESCRIPTION OF THE DRAWINGS

These and other objects and features of the present invention will become clear from the following description taken in conjunction with the preferred embodiments thereof with reference to the accompanying drawings throughout which like parts are designated by like reference numerals, and in which.

DETAIL DESCRIPTION OF THE INVENTION

Figure 1:
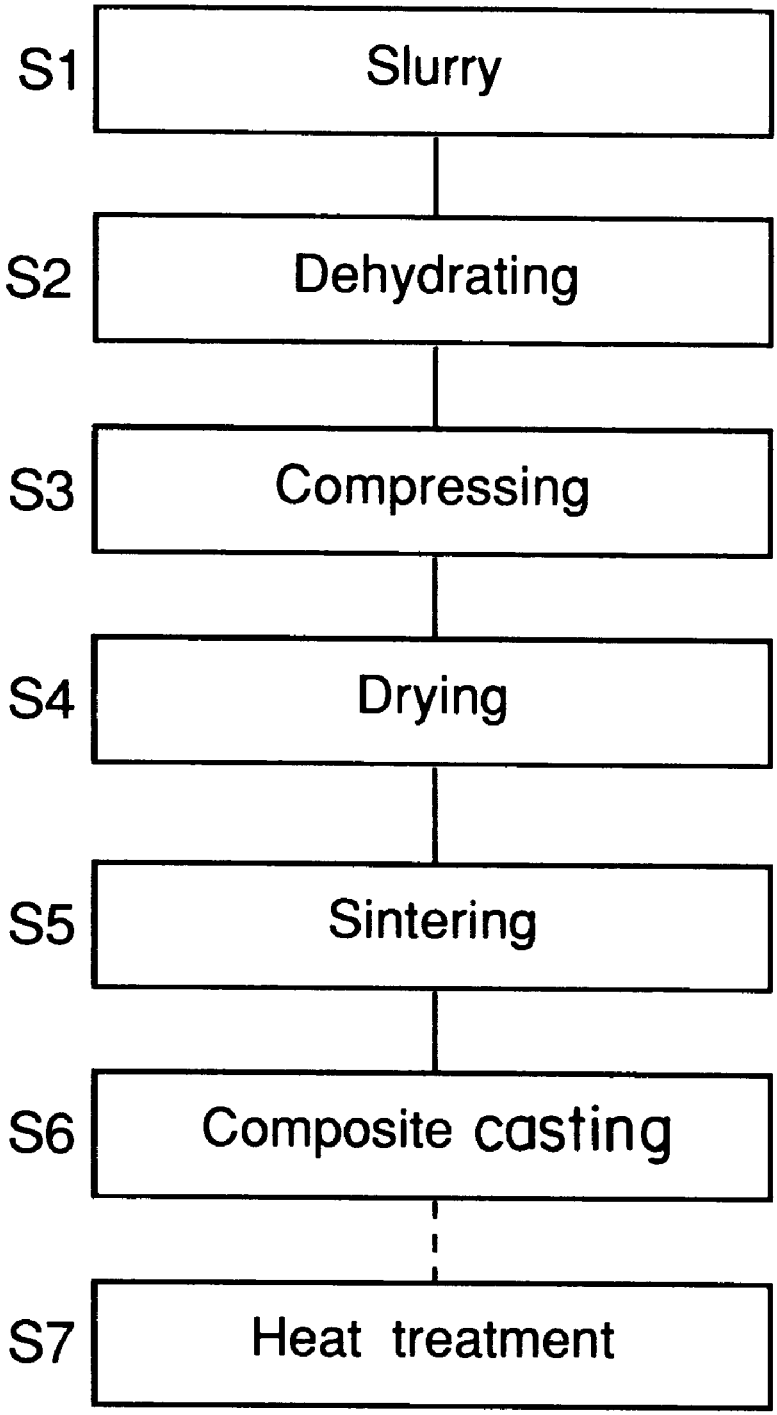
FIG. 1 is a block diagram showing the steps of preparing a partial reinforced aluminum alloy composite material.

According to the following steps of S1 (preparing the slurry), S2 (filtration), S3 (compressing), S4 (drying), S5 (sintering) to S6 (composite casting) or S7 (heat treatment is optional) as shown in FIG. 1, many kinds of the aluminum composite products were prepared.

The slurries were made of the following compositions.

Sample A

| | |
|---|---|
| SiC powders (average size of 15 $\mu$m) | 72 g |
| Al alloy powders (average size of 70 $\mu$m) (JIS AC4C alloy) | 77 g |
| Alumina sol (10%) | 10 ml |
| Pure water (impurity of ppm order) | 1000 ml |

-continued

| | | |
|---|---|---|
| Sample B | | |
| | Ni powders (average size of 30 μm) | 50 g |
| | Al alloy powders (average size of 70 μm) (JIS AC4C alloy) | 80 g |
| | Alumina sol (10%) | 10 ml |
| | Pure water (impurity of ppm order) | 1000 ml |
| Sample C | | |
| | SiC powders (average size of 15 μm) | 31 g |
| | Al alloy powders (average size of 70 μm) (JIS AC8A alloy) | 70 g |
| | Alumina sol (10%) (Aluminasol-520 made by Nissan Chemical Ltd.) | 10 ml |
| | Pure water (impurity of ppm order) | 1000 ml |
| Sample D | | |
| | SiC powders (average size of 15 μm) | 72 g |
| | Al alloy powders (average size of 70 μm) (JIS AC4C alloy) | 35 g |
| | Graphite powders (average size of 45 μm) | 35 g |
| | Alumina sol (10%) | 10 ml |
| | Pure water (impurity of ppm order) | 1000 ml |
| Sample E | | |
| | SiC powders (average size of 15 μm) | 31 g |
| | Al alloy powders (average size of 70 μm) (JIS AC8A alloy) | 36 g |
| | Alumina sol (10%) (Aluminasol-520 made by Nissan Chemical Ltd.) | 10 ml |
| | Pure water (impurity of ppm order) | 1000 ml |

Figure 2:
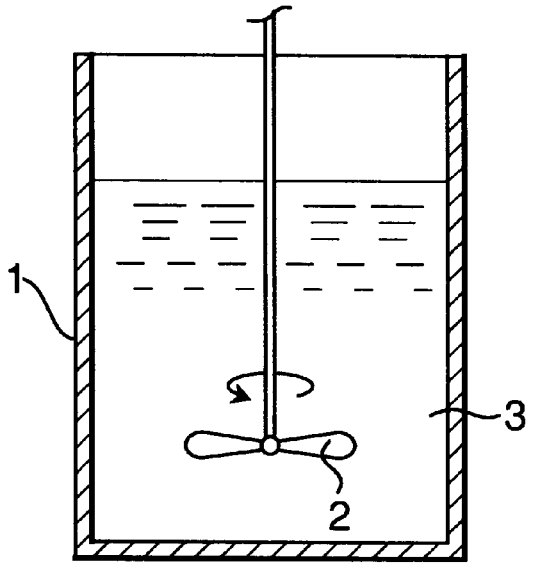
FIG. 2 is a schematic view showing a step of making slurry.

In the mixing step (S1), each mixture of the above compositions was added into a vessel 1 shown in FIG. 2, and stirred for 5 minutes by an agitating blade 2 to give a slurry 3.

Figure 3:
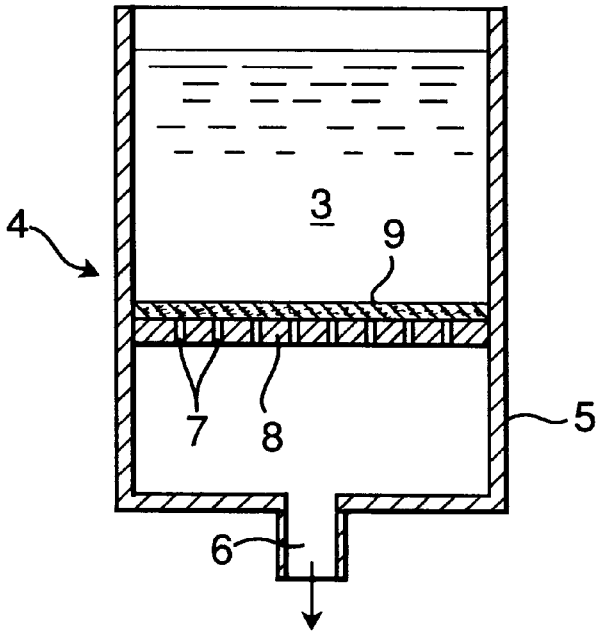
FIG. 3 is a schematic view showing a step of filtrating the slurry.

In the next filtration step (S2), the slurry 3 was dehydrated by means of suction of a filtration apparatus 4 as shown in FIG. 3, which comprises a vessel 5 having a slit plate 8 at a middle level which is provided with a lot of silts 7 covered with a paper filter 9 and a suction outlet 6 at a bottom level, so that the water of the slurry is discharged through the outlet 6 and the dehydrated material composed of the slurry components is remained on the filter 9.

Figure 4:
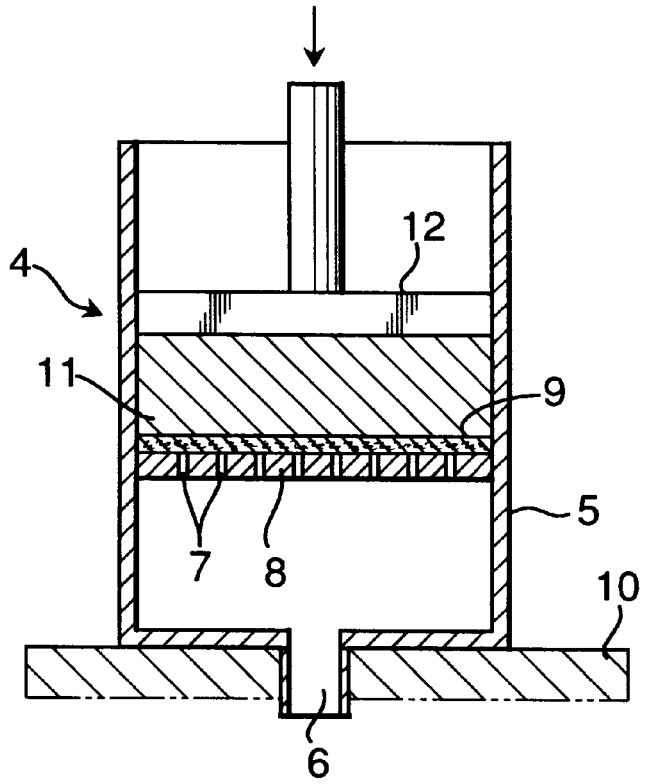
FIG. 4 is a schematic view showing a step of compressing the filtrated material.
Figure 5:
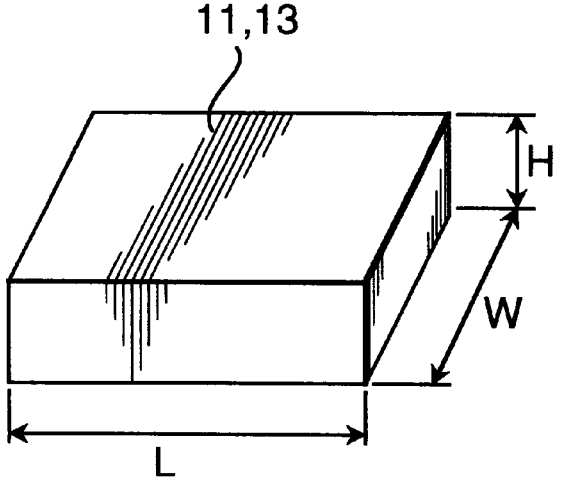
FIG. 5 is a schematic view showing the compressed material made by the step shown in FIG. 4.

In the third step (S3), the apparatus 4 including the dehydrated material 11 is placed on a base 10 as shown in FIG. 4 and the dehydrated material 11 is subjected to a compressing formation by means of a punch 12. If the resulting compressed material 11 has L=100 mm in length, W=40 mm in width and H=36 mm in height, it was observed that;

In case of Sample A: SiC: about 16 volume %, aluminum alloy(JIS AC4C alloy): about 19 volume % and spaces: balance.

In case of Sample B: Ni: about 6 volume %, aluminum alloy(JIS AC4C alloy): about 29 volume % and spaces: balance.

In case of Sample C: SiC: about 12 volume %, aluminum alloy(JIS AC8A alloy): about 30 volume % and spaces: balance.

In case of Sample D: SiC: about 16 volume %, aluminum alloy(JIS AC4C alloy): about 9 volume % and spaces: balance.

In case of Sample E: SiC: about 18 volume %, aluminum alloy(JIS AC4C alloy): about 24 volume % and spaces: balance.

In the fourth step (S4), the compressed material 11 is subjected to a drying process at a temperature range of 120 to 150° C. for about 1 to 4 hours.

In the fifth step (S5), the dried material is subjected to a sintering process at the following temperatures to give a preform.

Figure 9:
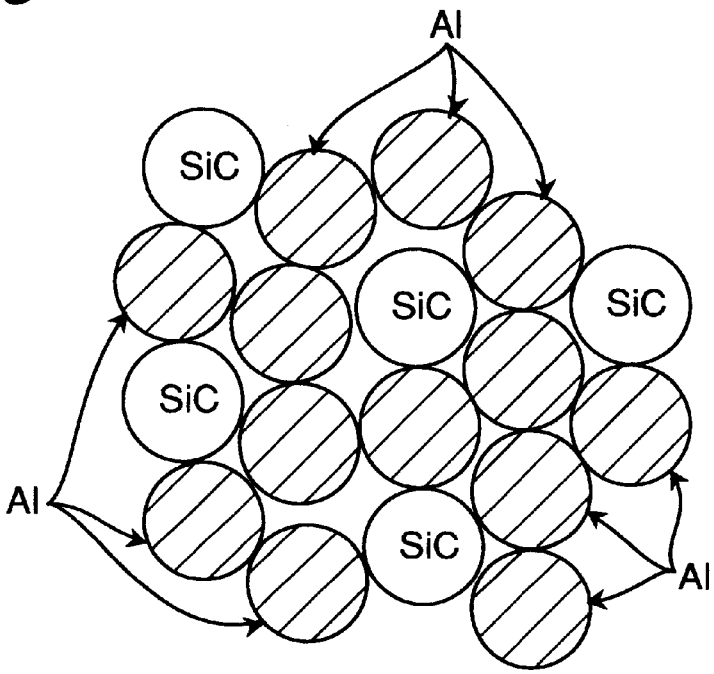
FIG. 9 is a schematic view illustrating a combined state between the aluminum alloy particles and the reinforcement particles in case of sintering the preform at a temperature lower than the melting point of the aluminum alloy particles.

In case of Sample A: sintering is carried out at about 500° C. for about 2 hours; resulting in formation of the preform as shown in FIG. 9 in which SiC particles and Al particles are bonded mainly by means of binding power of the alumina sol.

Figure 14:
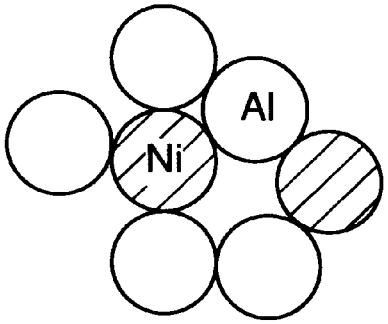
FIG. 14 is a schematic view showing a combined state between the aluminum alloy particles and the Ni particles in the preform before sintering.
Figure 15:
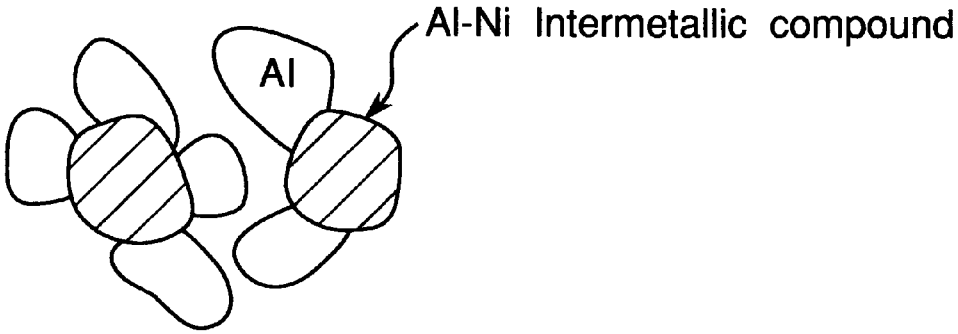
FIG. 15 is a schematic view showing a combined state between the aluminum alloy particles and the Ni particles in the preform after sintering.
Figure 16:
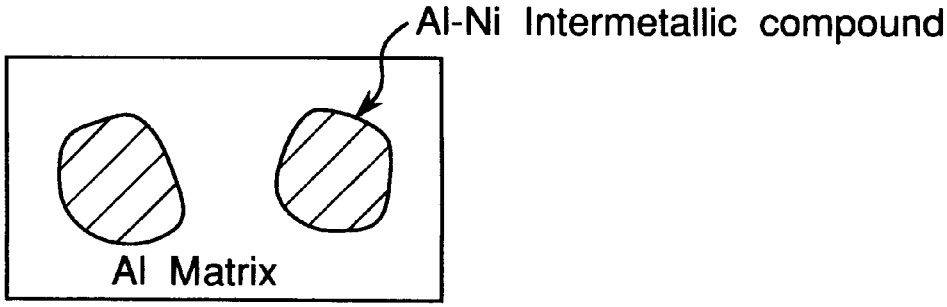
FIG. 16 is a schematic view showing a structure of the composite material prepared by one of the methods according to the present invention.

In case of Sample B: sintering is carried out at about 530° C. for 2 hours; resulting in formation of the preform as shown in FIG. 15 from FIG. 14, in which the metal particles are bonded to the Al alloy particles to form an intermetallic compound which shows much more strength than those of the matrix and the metal particles.

Figure 8:
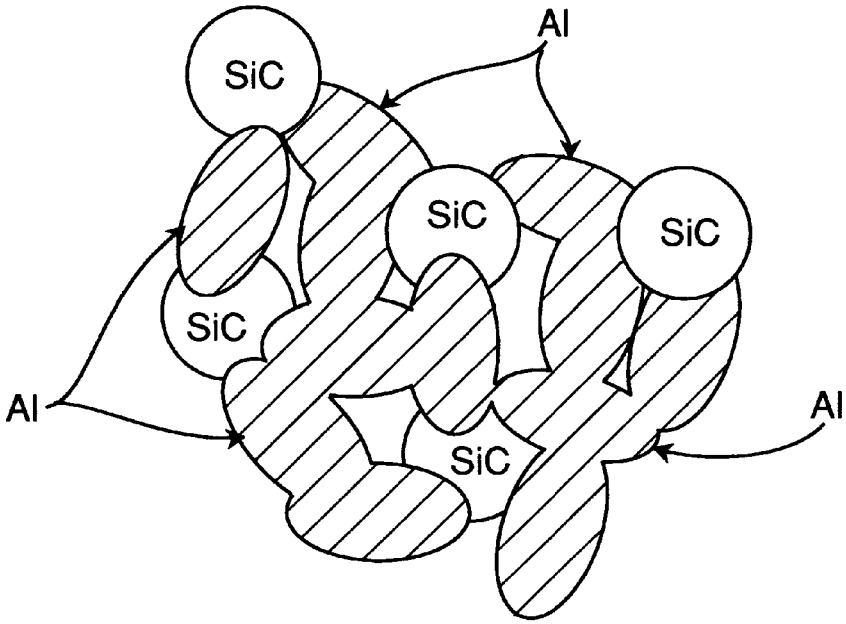
FIG. 8 is a schematic view illustrating a combined state between the aluminum alloy particles and the reinforcement particles in case of sintering the preform at a temperature higher than the melting point of the aluminum alloy particles.

In case of Sample C: sintering is carried out at about 840° C. for about 2 hours; resulting in formation of the preform as shown in FIG. 8 in which SiC particles are bonded by a melt of Al alloy and which shows the bonding power much more than the bonding power between the SiC particles and the Al alloy particles made by alumina sol.

Figure 20:
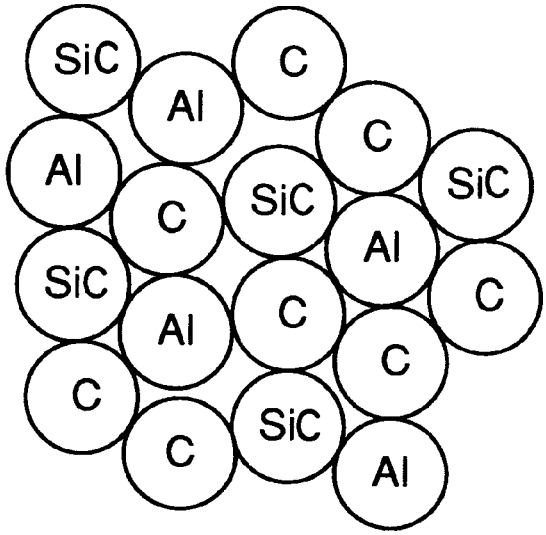
FIG. 20 is a schematic view showing a combined state between the aluminum alloy particles, SiC particles and graphite particles in the preform before sintering.
Figure 21:
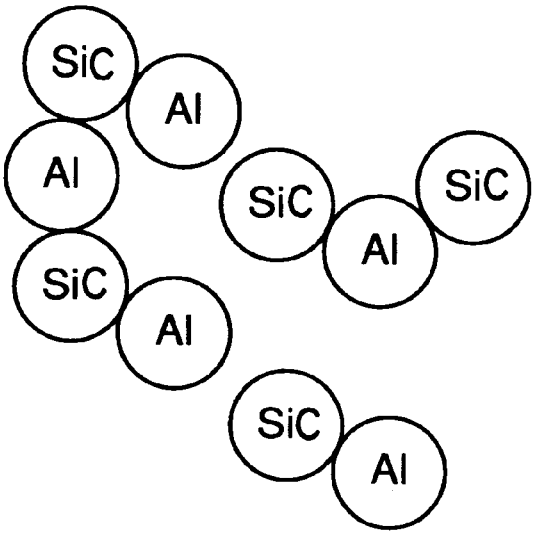
FIG. 21 is a schematic view showing a combined state between the aluminum alloy particles and SiC particles in the preform after sintering.

In case of Sample D: sintering is carried out at about 600° C. for about 2 hours; resulting in formation of the preform having increased spaces as shown in FIG. 21 due to disappearance of graphite reacted with oxygen from FIG. 20.

Figure 10:
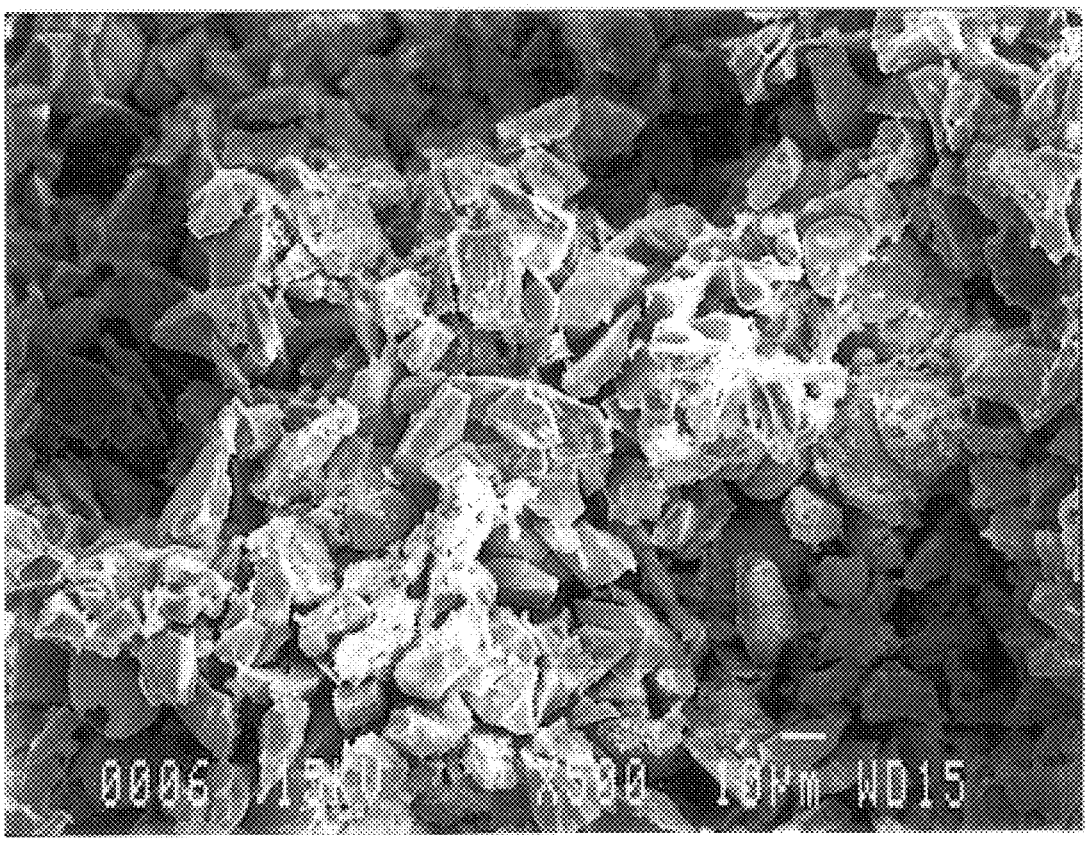
FIG. 10 is an electron microscope picture of the preform structure in case of sintering the preform at a temperature higher than the melting point of the aluminum alloy particles.
Figure 11:
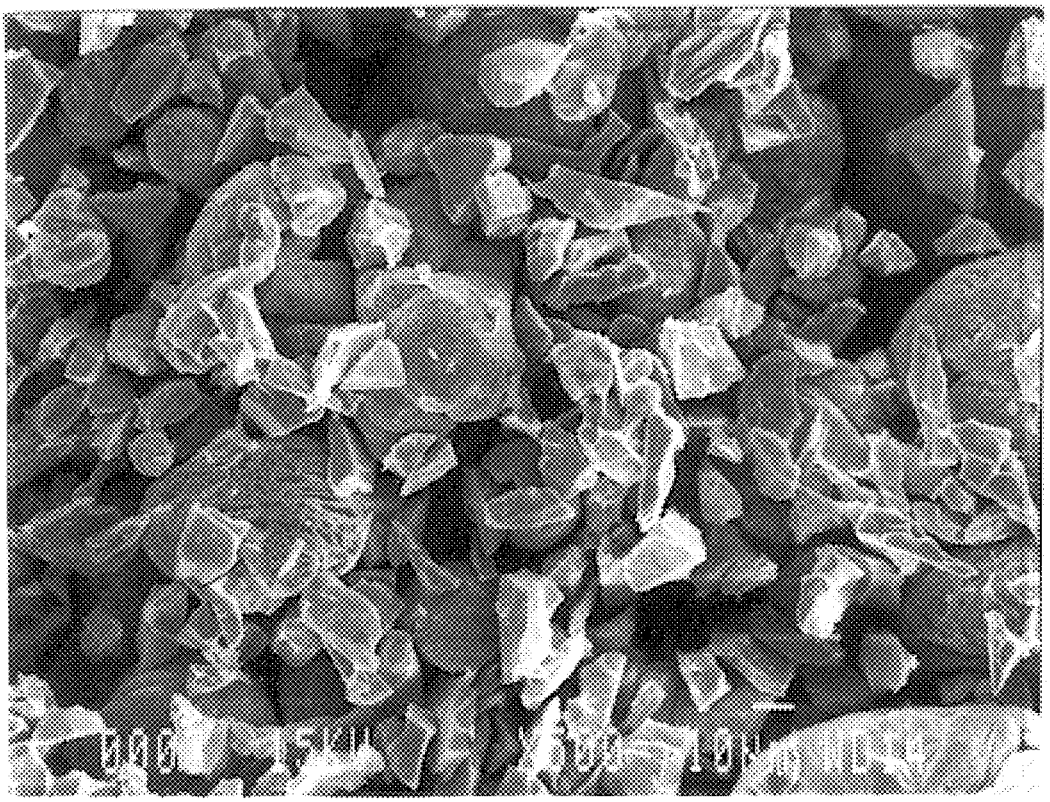
FIG. 11 is an electron microscope picture of the preform structure in case of sintering the preform at a temperature lower than the melting point of the aluminum alloy particles.

In case of Sample E: sintering is carried out at about 840° C. and 520° C. for about 2 hours; resulting in formation of the preform as shown in FIGS. 8 and 9. FIG. 10 is an electron microscope picture of about 500 magnifications after sintering at 840° C. for 2 hours and FIG. 11 is an electron microscope picture of about 500 magnifications after sintering at 520° C. for 2 hours.

Figure 6:
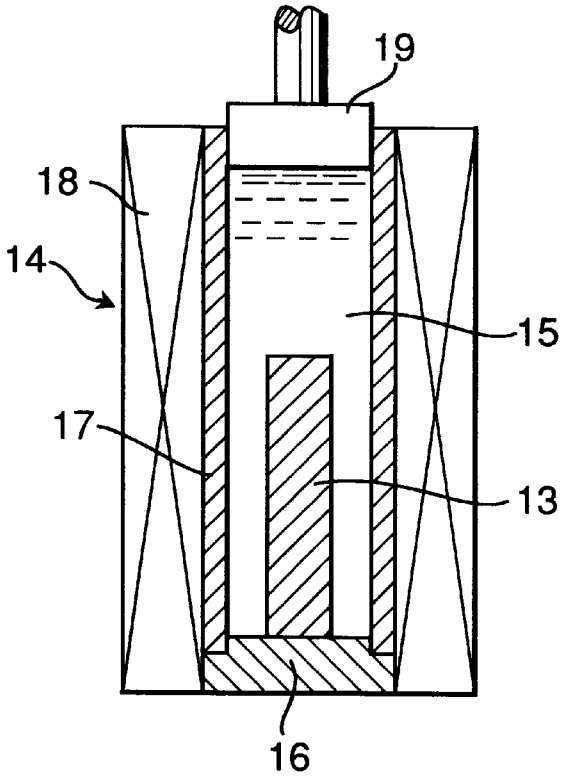
FIG. 6 is a schematic view showing a step of composite casting the sintered preform with a melt of light metal matrix.
Figure 7:
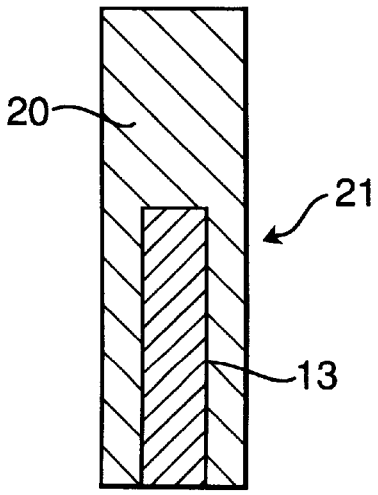
FIG. 7 is a sectional view of the partial reinforced aluminum alloy composite product.

In the sixth step (S6), the composite casting is carried out in a high pressure casting apparatus 14 as shown in FIG. 6, in which the sintered preform 13 is placed on a determined position and the preform 13 is combined with the Al alloy melt 15 to form a composite material 21 which matrix 20 is reinforced at necessary portions by the preform 13 as shown in FIG. 7.

The high pressure casting apparatus 14 comprises a pair of molds 16 and 17, a heater 18 and a punch 19, in which the preform 13 is placed on the mold 16 and the pair of molds 16 and 17 and the preform 13 are heated to a determined temperature (for example about 300° C.), and after that, the preform is impregnated with the aluminum melt 15 under pressure of about 20 tons by the punch 19.

Figure 18:
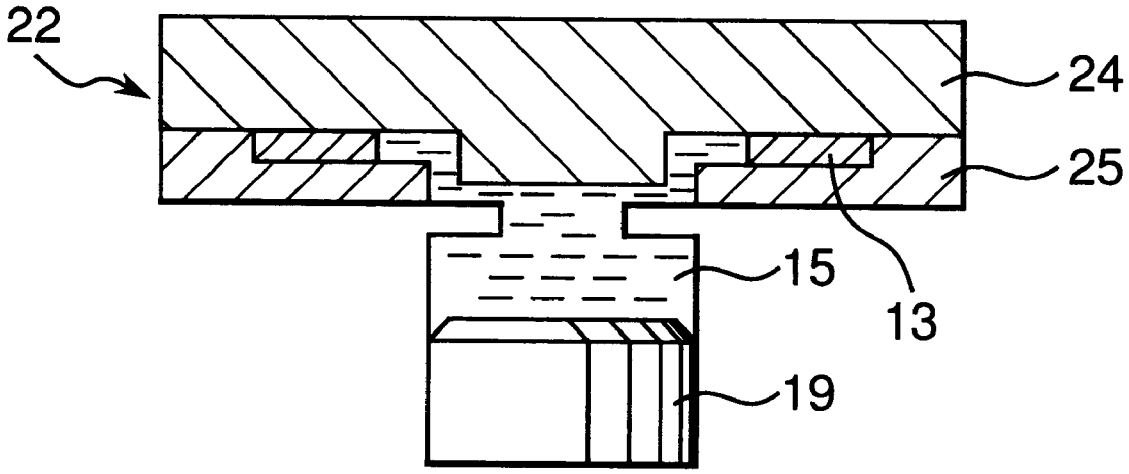
FIG. 18 is a schematic view showing an another step of composite casting the sintered preform with a melt of light metal matrix.
Figure 19:
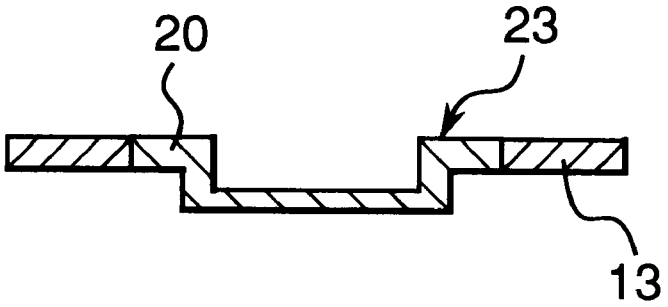
FIG. 19 is a sectional view of the partial reinforced aluminum alloy composite product prepared by the step of FIG. 18.

FIG. 18 shows another high pressure casting apparatus 22, which comprises a pair of molds 24 and 25. In the apparatus, there is prepared a partial composite aluminum alloy product 23 as shown in FIG. 19 which comprises the preform 13 and the aluminum alloy matrix 20 by impregnating the preform 13 with a melt of the aluminum alloy 15 by means of pressure of the punch 19.

Figure 17:
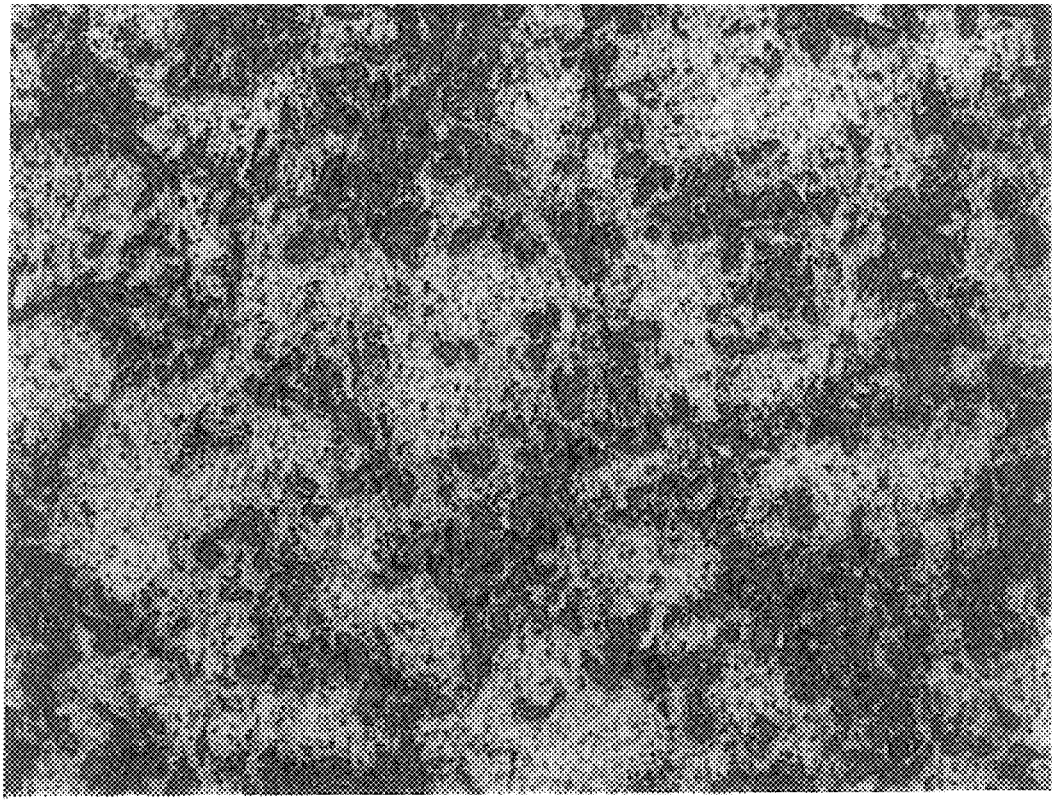
FIG. 17 is an electron microscope picture of the composite material structure prepared by the another method according to the present invention.

In case of Samples A, B and D, the aluminum melt of AC4C alloy is used while the aluminum melt of AC8A alloy is used in case of Samples C and E. FIG. 17 is a microscope picture (×200) of the composite material (Sample A), in which grey portions indicate SiC particles and white portions indicate Al alloy particles.

Further, in case of Samples C and E, the resulting composite material may be subjected to the seventh step (S7), that is, so-called T6 heat treatment, in which steps of keeping at 510° C. for about 4 hours, cooling by water, keeping at 170° C. and cooling by air are carried out in turn.

In these cases, since the sintering step was carried out at the temperature more than the melting point of the matrix metal, the alumina sol was sufficiently converted to γ-alumina and sufficient Mg remains, so that the T6 heat treatment makes the composite material to have $Mg_2Si$ which can improve the mechanical strength of the composite material.

TEST 1

Figure 12:
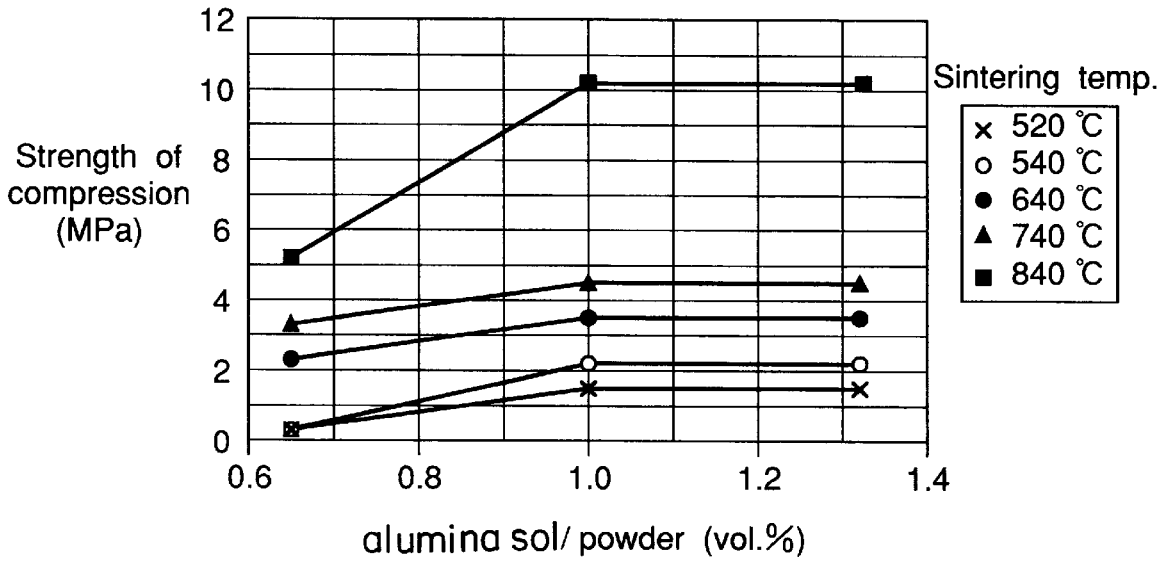
FIG. 12 is a graph showing relation between the sintering temperatures and the effect of improving the strength of the preform.

This test was carried out for confirming the relation between the sintering temperature and the effect of improving the strength of the preform by using Sample C. This Sample C was compressed into the preform having SiC: about 12 volume %, aluminum alloy(JIS AC8A alloy): about 30 volume % and spaces: balance. Each of the preforms was sintered respectively at 5 kinds of temperatures within a range from 520° C. to 840° C. The compressing strength of the sintered preforms are measured and the results are shown in FIG. 12. The effect depending on the amount of the alumina sol was also investigated.

Seen from FIG. 12, the higher the sintering temperature becomes, the more the compressing strength improves. If the alumina sol is used at an amount less than a determined limit, the more the amount of the alumina sol becomes, the more the compressing strength improves. That is, if the amount of the alumina sol increases, the preform sintered even at a lower temperature could have substantially the same strength.

TEST 2

This test was carried out for confirming the relation between the sintering temperature and the effect of heat treatment after composite casting by using Sample E. This Sample E was compressed into the preform having SiC: about 18 volume %, aluminum alloy(JIS AC8A alloy): about 24 volume % and spaces: balance. Each of the preforms was sintered respectively at many kinds of temperatures within a range from 500° C. to 840° C. The Vickers hardness (Hv) of the composite materials (T6) subjected to T6 treatment and the composite materials (F) not subjected to T6 treatment are measured respectively and the results are shown in FIG. 13.

Figure 13:
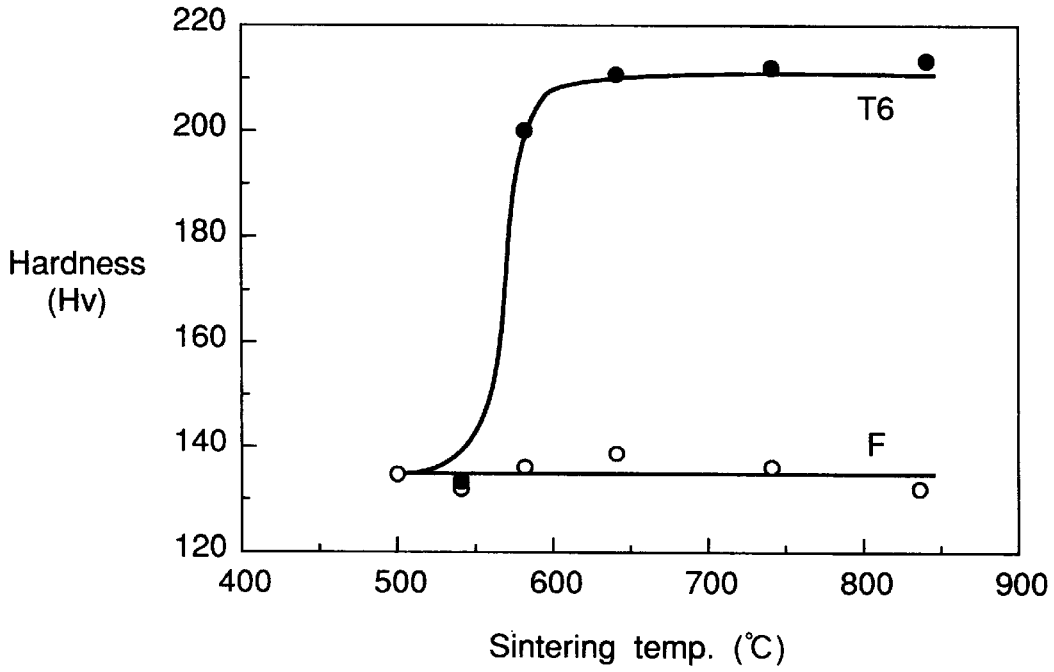
FIG. 13 is a graph showing relation between the sintering temperature and the effect of the heat treatment.

Seen from FIG. 13, in case that the sintering temperature is lower than the melting point of the aluminum alloy powders, little effect of the heat treatment can be observed, while in case that the sintering temperature is higher than the melting point, substantial effect of the heat treatment can be observed and the hardness of the composite material becomes much improved.

What is claimed is:

1. A method for preparing a light metal or light metal alloy composite product, comprising:

(a) preparing an aqueous slurry comprising water, a reinforcement powder, a metal powder selected from the group consisting of a light metal powder and a light metal alloy powder, and an alumina sol binder;

(b) preparing a preform from said slurry;

(c) sintering said preform;

(d) impregnating the sintered preform in a mold with a melt of a light metal or a light metal alloy to produce a light metal or a light metal alloy based composite product, wherein the light metal with which said sintered preform is impregnated in step (d) is the same light metal as used in the light metal powder of said slurry; or wherein the light metal of the light metal alloy with which said sintered preform is impregnated in step (d) is the same light metal as the light metal of the light metal alloy powder of said slurry.

2. The method for preparing a light metal or light metal alloy based composite product according to claim 1, wherein the light metal is aluminum and the light metal alloy is selected from the group consisting of Al alloy and Mg alloy.

3. The method for preparing a light metal or light metal alloy based composite product according to claim 1, wherein said slurry further comprises a volatile material for making spaces in said sintered preform due to volatilization during the sintering step.

4. The method of preparing a light metal or light metal alloy based composite product according to claim 3, wherein said volatile material is graphite or an organic material.

5. The method for preparing a light metal or light metal alloy based composite product according to claim 1, wherein said reinforcement powder comprises a ceramic powder.

6. The method for preparing a light metal or light metal alloy based composite product according to claim 5, wherein said ceramic powder is selected from the group consisting of SiC, SiN, $TiO_2$ and $Al_2O_3$.

7. The method for preparing a light metal or light metal alloy based composite product according to claim 1, wherein said reinforcement powder is selected from the group consisting of Ni, Cu, Fe and Ti.

8. The method for preparing a light metal or light metal alloy based composite product according to claim 1, wherein step (b) comprises:

(b1) dehydrating said slurry in a preform mold to prepare a dehydrated preform comprising said reinforcement powder and said binder; and (b2) compressing the dehydrated preform.

9. The method for preparing a light metal or light metal alloy based composite product according to claim 1, wherein said sintering step is carried out within a temperature range of 580 to 900° C.

10. The method for preparing a light metal or light metal alloy based composite product according to claim 1, further comprising subjecting said composite product to T6 heat treatment.

11. The method of preparing a light metal or light metal alloy based composite product according to claim 1, wherein step (c) is carried out to change said metal powder at least partially into a melt or a semi-melt condition and to make said reinforcement powder combine in a network form with said melt or said semi-melt of said metal powder.

12. The method of preparing a light metal or light metal alloy based composite product according to claim 1, wherein said metal powder is aluminum and said melt comprises aluminum or an aluminum alloy.

13. The method for preparing a light metal or light metal alloy based composite product according to claim 1, wherein an amount of said binder is 0.5 to 5 wt.% based on a weight of said reinforcement powder or 0.5 to 3 wt.% based on a total weight of said metal powder and said reinforcement powder.

14. A method for preparing a sintered preform for a light metal or light metal alloy based composite product, comprising:

(a) preparing an aqueous slurry comprising water, a reinforcement powder, a metal powder selected from the group consisting of a light metal powder and a light metal alloy powder, and an alumina sol binder;

(b1) dehydrating said slurry in a preform mold to form a dehydrated preform;

(b2) compressing said dehydrated preform to form a compressed preform;

(c) sintering said compressed preform to form said sintered preform.

15. The method for preparing preform for a light metal or light metal alloy based composite product according to claim 14, wherein said slurry further comprises a volatile material for making spaces in said sintered preform due to volatilization during the sintering step.

16. The method for preparing a preform according to claim 14, wherein said reinforcement powder comprises a ceramic powder.

17. The method for preparing a preform according to claim 16, wherein said ceramic powder is selected from the group consisting of SiC, SiN, $TiO_2$ and $Al_2O_3$.

18. The method for preparing a preform according to claim 14, wherein said reinforcement powder is selected from the group consisting of Ni, Cu, Fe and Ti.

19. The method for preparing a preform according to claim 14, wherein said binder is alumina sol of 0.5 to 5 wt.% based on the weight of said reinforcement material or is alumina sol of 0.5 to 3 wt.% based on the total weight of said light metal powders or said light metal based alloy powders and said reinforcement material.

20. The method of preparing preform for a light metal or light metal alloy based composite product according to claim 14, wherein step (c) is carried out to change said metal powder at least partially into a melt or a semi-melt condition and to make said reinforcement powder combine in a network form with said melt or said semi-melt of said metal powder.

21. The method of preparing preform for a light metal or light metal alloy based composite product according to claim 14, wherein step (c) is carried out within a temperature range of 580 to 900° C.

22. The method of preparing preform for a light metal or light metal alloy based composite product according to claim 13, wherein said metal powder is an aluminum alloy and said melt is aluminum or an aluminum alloy.

23. The method of preparing preform for a light metal or light metal alloy based composite product according to claim 15, wherein said volatile material is graphite or an organic material.

24. The method for preparing preform for a light metal or light metal alloy based composite product according to claim 14, wherein an amount of said binder is 0.5 to 5 wt.% based on a weight of said reinforcement powder or 0.5 to 3 wt.% based on a total weight of said metal powder and said reinforcement powder.

25. A method for preparing a light metal or light metal alloy composite product, comprising:

(a) preparing an aqueous slurry comprising water, a reinforcement powder, a metal powder selected from the group consisting of a light metal powder and a light metal alloy powder, and an alumina sol binder;

(b) preparing a preform from said slurry;

(c) sintering said preform;

(d) impregnating the sintered preform in a mold with a melt of a light metal or a light metal alloy to produce a light metal or a light metal alloy based composite product, wherein the light metal with which said sintered preform is impregnated in step (d) is the same light metal as used in the light metal powder of said slurry; or wherein the light metal of the light metal alloy with which said sintered preform is impregnated in step (d) is the same light metal as the light metal of the light metal alloy powder of said slurry, wherein said reinforcement powder is SiC of 10 to 20 $\mu$m grain size.

26. A method for preparing a sintered preform for a light metal or light metal alloy based composite product, comprising:

(a) preparing an aqueous slurry comprising water, a reinforcement powder, a metal powder selected from the group consisting of a light metal powder and a light metal alloy powder, and an alumina sol binder;

(b1) dehydrating said slurry in a preform mold to form a dehydrated preform;

(b2) compressing said dehydrated preform to form a compressed preform;

(c) sintering said compressed preform to form said sintered preform, wherein said reinforcement powder is SiC of 10 to 20 $\mu$m grain size.

27. The method for preparing preform for a light metal or light metal alloy based composite product according to claim 26, wherein an amount of said binder is 0.5 to 5 wt.% based on a weight of said reinforcement powder or 0.5 to 3 wt.% based on a total weight of said metal powder and said reinforcement powder.

* * * * *